United States Patent [19]

Watanabe

[11] Patent Number: 4,678,315

[45] Date of Patent: Jul. 7, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 791,459

[22] Filed: Oct. 25, 1985

[30] Foreign Application Priority Data

Oct. 27, 1984 [JP] Japan ..... 59-226158
Oct. 29, 1984 [JP] Japan ..... 59-227420

[51] Int. Cl.[4] ..... G03G 15/00

[52] U.S. Cl. ..... 355/7; 355/84 R; 355/35 H; 355/71; 355/3 R

[58] Field of Search ..... 355/7, 71, 14 SH, 35 H, 355/14 R, 3 R

[56] References Cited

U.S. PATENT DOCUMENTS

| | | | |
|---|---|---|---|
| 3,685,894 | 8/1972 | Lux et al. | 355/3 R |
| 4,255,042 | 3/1981 | Armitage, Jr. et al. | 355/3 R |
| 4,256,400 | 3/1981 | Komori et al. | 355/7 X |
| 4,334,763 | 6/1982 | Honda et al. | 355/2 R X |
| 4,582,417 | 4/1986 | Yagasaki et al. | 355/14 R X |
| 4,585,332 | 4/1986 | Shenoy | 355/3 SH X |

FOREIGN PATENT DOCUMENTS

| | | |
|---|---|---|
| 0175962 | 4/1986 | European Pat. Off. . |
| 3341774 | 5/1984 | Fed. Rep. of Germany . |
| 3411969 | 10/1984 | Fed. Rep. of Germany . |
| 56-133753 | 10/1981 | Japan . |
| 2100647 | 7/1979 | United Kingdom . |

OTHER PUBLICATIONS

Research Disclosure, No. 22737, "Copying Machine", Mar. 1983, pp. 116–118.

*Primary Examiner*—A. G. Prescott
*Attorney, Agent, or Firm*—Schwartz, Jeffery, Schwaab, Mack, Blumenthal & Evans

[57] ABSTRACT

An image forming apparatus has a light-emitting element for designating, with a spotlight, a specific range on an original placed on an original table. Other light-emitting elements are used to charge a surface of a photosensitive body which corresponds to the specific range or to erase an electrostatic latent image, thereby forming an image that excludes that portion of the original designated as lying within the specific range.

15 Claims, 31 Drawing Figures

IMAGE FORMING APPARATUS

BACKGROUND OF THE INVENTION

The present invention relates to an image forming apparatus for partially erasing an image of an original document and performing selective copying.

Conventional image forming apparatuses such as electronic copying machines have a function of copying an image of an original in an equal, enlarged or reduced size.

Despite the presence of portions not desired for copying, no conventional copying machine has the capacity to copy only that portion that is wanted. Consequently, demand has arisen for a copying machine capable of effectively designating an erasure range on an image of the original.

SUMMARY OF THE INVENTION

It is an object of the present invention to provide an image forming apparatus capable of designating, with ease of operation, any portion of an image of an original, and erasing the designated portion from a copied sheet.

In order to achieve the above object of the present invention, there is provided an image forming apparatus for focussing a spotlight on an original, designating an erasure range by shifting the spotlight on the original, reflecting the light to a photosensitive drum in correspondence with the designated erasure range, to erase or discharge the corresponding electrostatic latent image, and, thereafter, copying the image on a sheet.

BRIEF DESCRIPTION OF THE DRAWINGS

FIGS. 1 to 29 are views of an image forming apparatus according to an embodiment of the present invention, in which FIG. 1 is a perspective view of the outer configuration of the apparatus, FIG. 2 is a side sectional view of the apparatus of FIG. 1, FIG. 3 is a plan view of a control panel thereof, FIG. 4 is a perspective view of an arrangement of a drive mechanism thereof, FIG. 5 is a perspective view of the drive mechanism of an optical system thereof, FIG. 6 is a perspective view of the drive mechanism of indexes thereof, FIG. 7 is a block diagram of the overall configuration of a control circuit thereof, FIG. 8 is a block diagram of a main processor group thereof, FIG. 9 is a block diagram of a first sub-processor group thereof, FIG. 10 is a block diagram of a second sub-processor group, FIG. 11 is a block diagram of a control circuit for a pulse motor, FIG. 12 is a view illustrating speed control of the pulse motor, FIG. 14 is a perspective view of the spotlight source used in the apparatus, FIG. 15 is a sectional view of the spotlight source, FIGS. 16 to 20 are views illustrating designation of an erasure range using the spotlight source, FIG. 21 is a side sectional view of the arrangement of an erasure array, FIGS. 22 and 23 are respectively a perspective view and a front view showing the relationship between the erasure array and the photosensitive drum, FIGS. 24 and 25 are respectively a side sectional view and a cutaway front view of the erasure array, FIG. 26 is a block diagram of an array drive mechanism, FIG. 27 is a sectional side view of another arrangement of the erasure array, and FIGS. 28 and 29 are views of the relationship between the spotlight diameter and the erasure designation range.

DETAILED DESCRIPTION OF THE PREFERRED EMBODIMENT

An image forming apparatus according to an embodiment of the present invention will be described with reference to the accompanying drawings.

Figure 1:
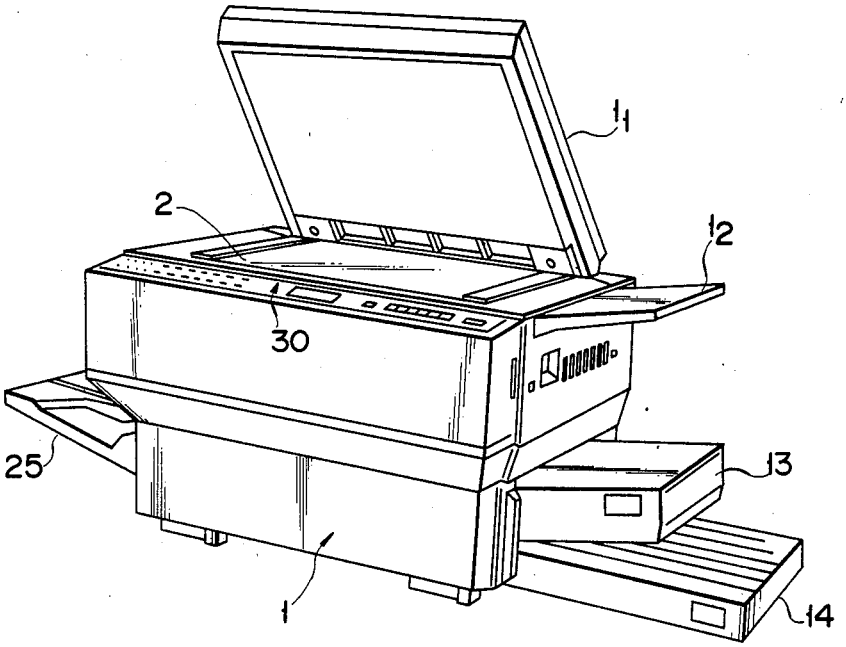
Figure 2:
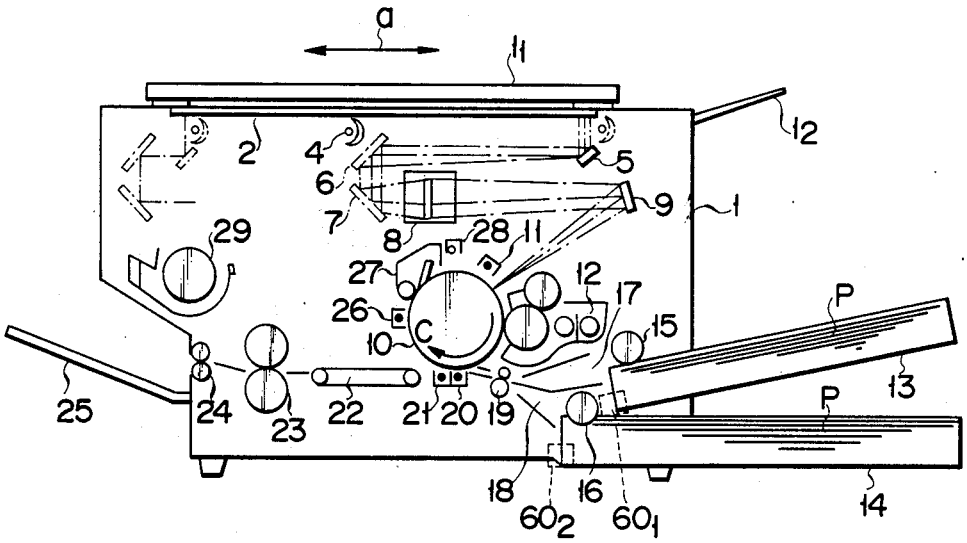

FIGS. 1 and 2 are schematics of an image forming apparatus such as a copying machine. A table (a transparent glass) 2 for supporting an original is fixed on the upper surface of a housing 1. A stationary scale $2_1$ is disposed in the table 2 and serves as a set reference. An openable original cover $1_1$ and a work table $1_2$ are arranged near the table 2. The original placed on the table 2 can be scanned while an optical system consisting of an exposure lamp 4 and mirrors 5, 6 and 7 reciprocates back and forth in the direction indicated by arrow a. In this case, the mirrors 6 and 7 are moved at a speed half that of the mirror 5 so as to ensure the optical length. Light reflected by the original upon scanning of the optical system, that is, light reflected by the original upon illumination from the lamp 4, is reflected by the mirrors 5, 6 and 7 and passes through a magnification change lens block 8. The light is then reflected by the mirror 9, and the reflected light is guided to a photosensitive drum 10. The image of the original is focused on the surface of the drum 10.

The drum 10 is rotated in the direction indicated by arrow c and is charged by a charger 11. Thereafter, the image is exposed through a slit, so that a latent image is formed on the surface of the drum 10. The latent image is rendered visible by a developing unit 12 upon attachment of toner to the latent image.

Sheets (transfer media) P are fed from a selected upper or lower paper cassette 13 or 14 by a pickup roller 15 or 16, one by one. The fed sheet is guided to an aligning roller pair 19 through a paper guide path 17 or 18. The sheet is then fed by the rollers 19 to the transfer section. The cassettes 13 and 14 are detachably attached to a portion of the lower end of the right side of the housing 1. An operator selects one of the cassettes, at a control panel to be described later. The sizes of the cassettes 13 and 14 are detected by cassette size sensor switches $60_1$ and $60_2$, respectively. The switches $60_1$ and $60_2$ comprise a plurality of microswitches which are respectively turned on/off upon attachment/detachment of the corresponding cassettes.

The sheet P fed to the transfer section is brought into close contact with the surface of the drum 10, and a toner image is transferred by the charger 20 from the surface of the drum 10 to the sheet P. The image-transfer sheet P is electrostatically separated from the drum 10 by a separating charger 21, and the sheet is fed to the fixing roller 23 which serves as a fixing unit arranged at the terminal end of a conveyor belt 22. The transfer image is fixed while the sheet passes by the fixing roller 23. The sheet P is finally discharged by a discharge roller pair 24 outside the housing 1 and is placed on a tray 25. After the transfer operation the drum 10 is discharged by a charger 26, and residual toner left on its surface is removed by a cleaner 27. The surface of the drum 10 is finally quenched by a lamp 28, so that the drum 10 is restored to its original state. Reference numeral 29 denotes a cooling fan for preventing a rise in temperature.

Figure 3:
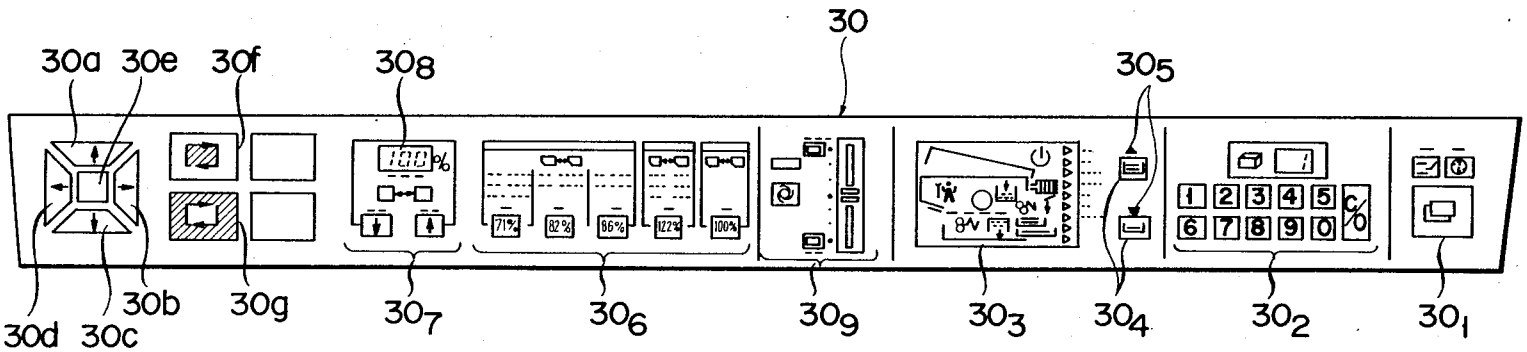

FIG. 3 shows a control panel 30 arranged on the housing 1. Reference numeral $30_1$ denotes a copying key for designating start of copying; $30_2$, a numeric-key pad for entering a copying number; $30_3$, a display for displaying operating states of the respective components: paper jam and the like; $30_4$, a cassette selection key for selecting one of the cassettes 13 and 14; $30_5$, a cassette display for displaying the selected cassette; $30_6$, a magnification setting key for setting an enlargement or reduction coefficient of an image at a predetermined rate; $30_7$, a zoom key for setting an enlargement or reduction coefficient of the image in a nonstep manner; $30_8$, a display for displaying the set enlargement or reduction coefficient; $30_9$, a density setting section for setting the copying density; 30*a*, 30*b*, 30*c* and 30*d* designate operation keys for shifting a spotlight source which represents an erasure position (to be described later) on an original; 30*e*, a position designation key for entering coordinates representing the spotlight source position; and 30*f* and 30*g*, erasure range keys for designating an erasure range at the designated positions.

Figure 4:
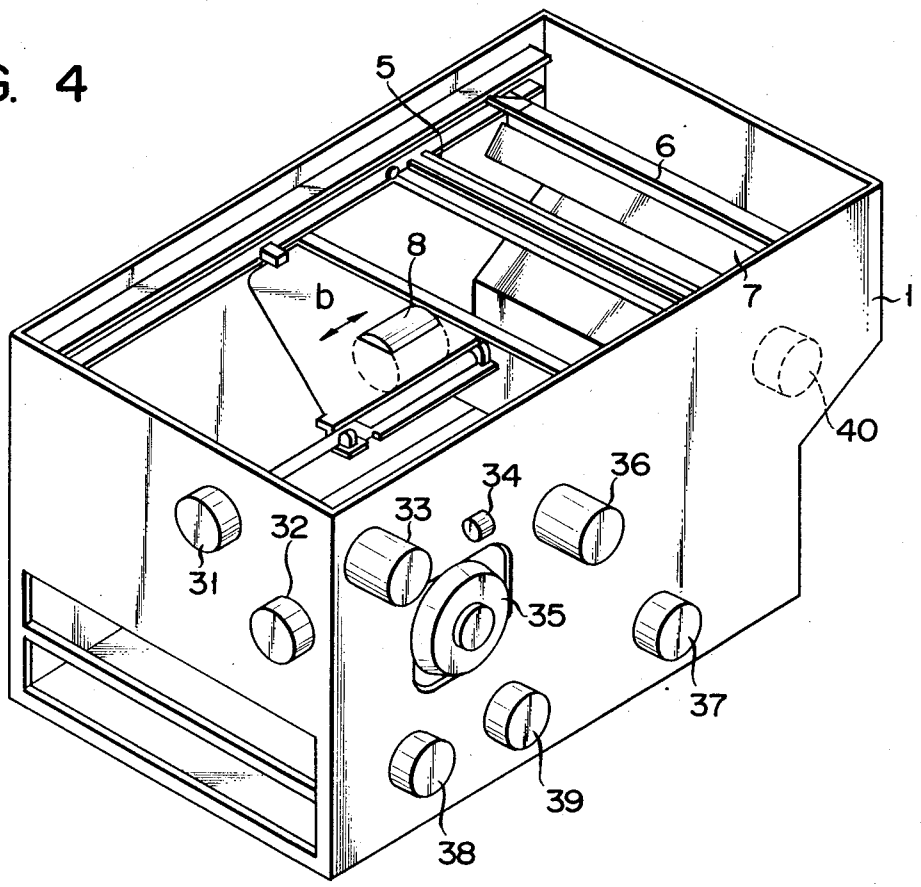

FIG. 4 shows the arrangement of drive sources of the respective drive mechanisms in the copying machine arranged as described above. The drive sources are given as follows. Reference numeral 31 denotes a lens motor for shifting the position of the block 8 so as to form an enlarged or reduced image; 32, a mirror motor for changing the optical length such that it corresponds to the distance between the mirror 5 and the mirrors 6 and 7; 33, an original scanning mirror for moving the mirrors 5, 6 and 7 so as to scan the original; 34, a shutter mirror for moving a shutter (not shown) to adjust the charge width of the charger 11 for the drum 10, in the magnification change mode; 35, a developing motor for driving the developing roller 12 in the unit 12; 36, a drum motor for driving the drum 10; 37, a fixing motor for driving the path 22 and the fixing roller 23 and 24; 38, a paper feed motor for driving the pickup roller 15 and 16; 39, a paper feed motor for driving the aligning roller 19; and 40, a fan motor for driving the fan 29.

Figure 5:
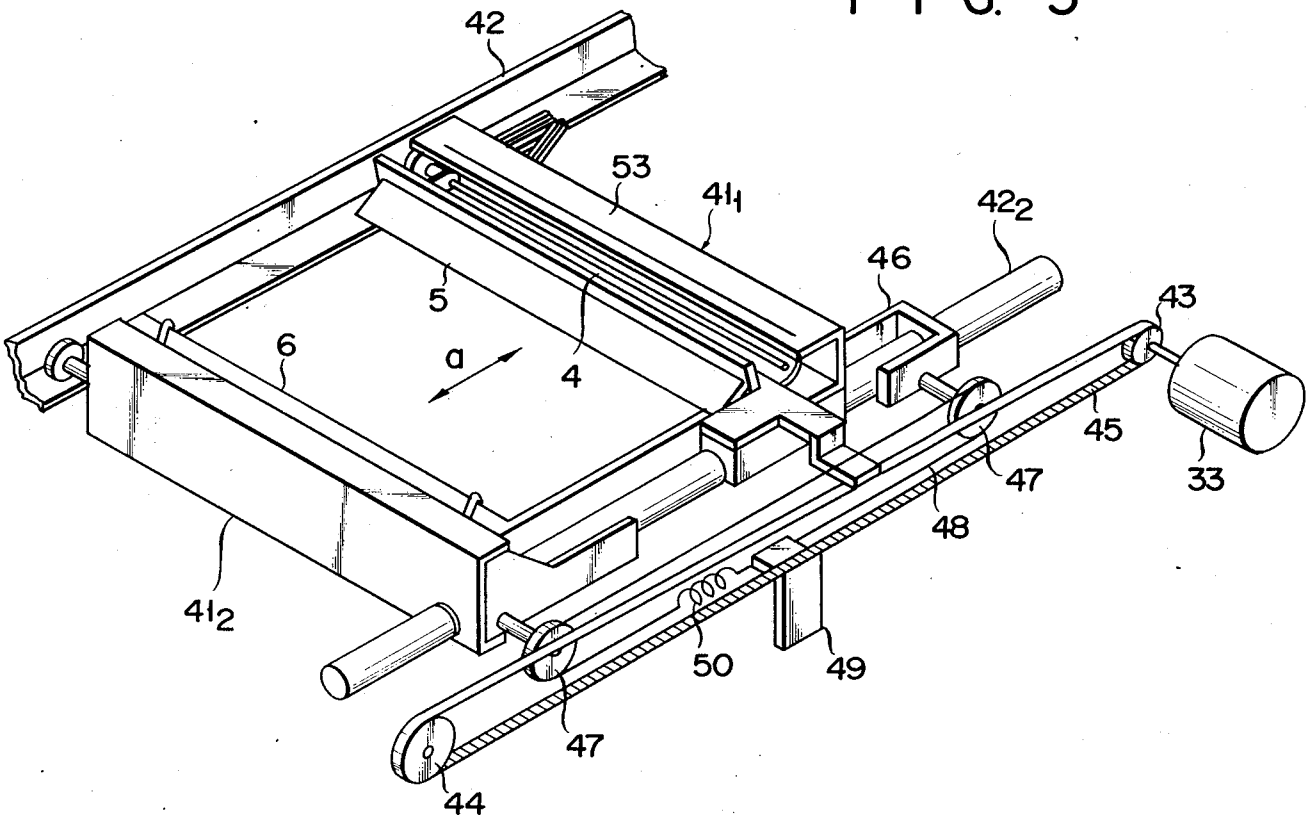

FIG. 5 shows the optical system drive mechanism. The mirror 5 and the lamp 4 are supported on the first carriage $41_1$, and the mirrors 6 and 7 are supported on the second carriage $41_2$. The carriages $41_1$ and $41_2$ are guided along guide rails $42_1$ and $42_2$ and are moved parallel to each other in the direction indicated by arrow a. The 4-phase motor 33 drives a pulley 43. An endless belt 45 is looped between the pulley 43 and an idler pulley 44. One end of the mirror 5 supporting carriage $41_1$ is fixed midway along the belt 45. Two pulleys 47 are rotatably provided in a guide portion 46 in the carriage $41_2$ for supporting the mirrors 6 and 7, and are spaced apart along the axial direction of the rail $42_2$. A wire 48 is looped between the pulleys 47. One end of the wire 48 is fixed to a stationary portion 49, and the other end thereof is fixed to the portion 49 through a coil spring 50. One end of the carriage $41_1$ is fixed midway along the wire 48. When the motor 33 is rotated, the belt 35 is rotated accordingly. The carriage $41_1$ and then the carriage $41_2$ are moved. In this case, the pulleys 47 serve as movable rollers, so that the carriage $41_2$ is moved at a speed half that of the carriage $41_1$. The direction of the carriages $41_1$ and $41_2$ movement is controlled by changing the rotational direction of the motor 33.

A possible copying range corresponding to the specified sheet size is displayed in the Table 2. Assume that a paper size designated by the key $30_4$ is given as (Px,Py) and a copying magnification coefficient designated by the keys $30_6$ and $30_7$ is given as K. A possible copying range (x,y) is defined as "x=Px/K" and "y=Py/K". An x-axis length of the range (x,y) is displayed as a mutual distance between indexes 51 and 52 arranged on the lower surface of the table 2, and a y-axis length is displayed on a scale 53 arranged on the upper surface of the carriage $41_1$.

Figure 6:
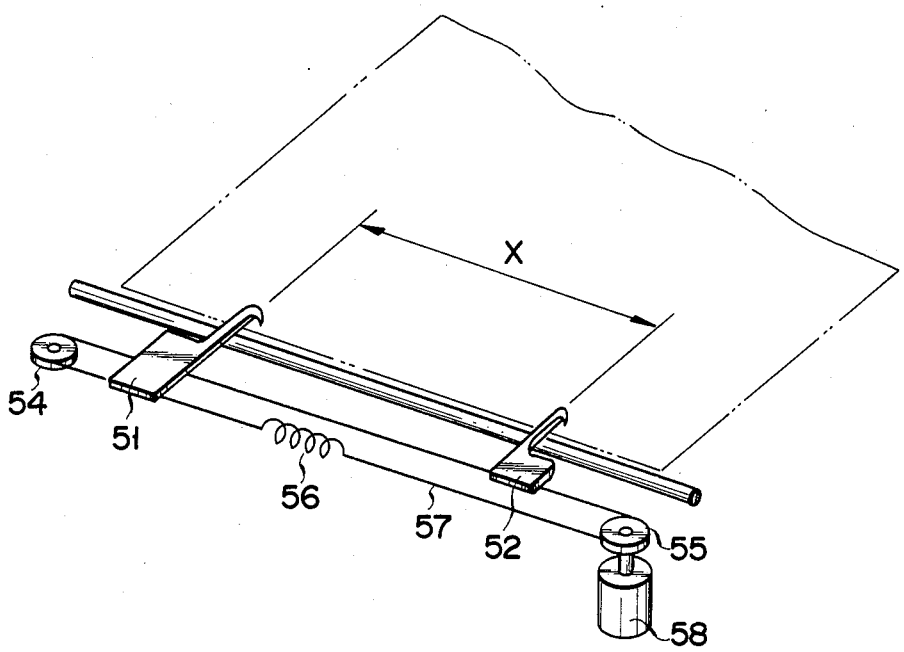

The indexes 51 and 52 are arranged on a wire 57 looped around pulleys 54 and 55 through a spring 56, as shown in FIG. 6. The pulley 55 is rotated by the motor 58. When the motor 58 is driven to achieve copying in the x direction, the distance between the indexes 51 and 52 can be changed.

The carriage $41_1$ is driven by the motor 33 to a predetermined position (i.e., a home position based on each magnification coefficient) in accordance with the paper size and the magnification coefficient. When the key $30_1$ is depressed the carriage $41_1$ is moved toward the carriage $41_2$. Thereafter, the lamp 4 is turned on, and the carriage $41_1$ is moved away from the carriage $41_2$. When original scanning is completed, the lamp 4 is turned off and the carriage $41_1$ returns to the home position.

Figure 7:
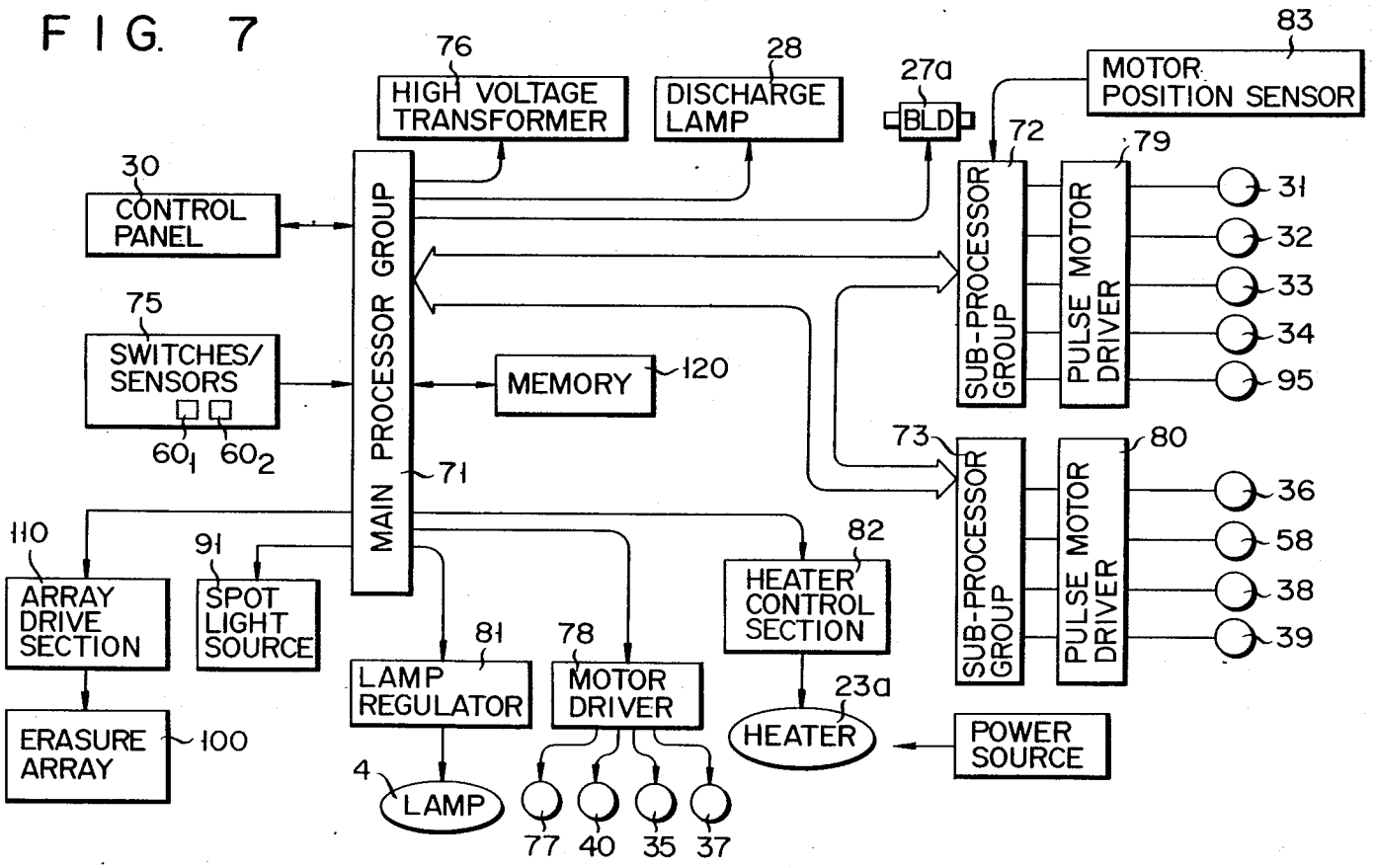

FIG. 7 shows the overall arrangement of a control circuit. A main processor group 71 receives output from the panel 30 and the switches and sensors (switches/sensors 75 such as the switches $60_1$ and $60_2$), and controls a high voltage transformer 76 for driving the various chargers described above: the lamp 28, a blade solenoid 27*a* of the cleaner 27, a heater 23*a* of the pair 23, the lamp 4 and the motors 31 to 40 and 58, thereby performing copying. At the same time, the group 71 also controls a spotlight source 131, a pulse motor 135, a memory 140, an erasure array 150 and an array drive mechanism 160 so as to erase the unwanted portion of the original. The source 131, the motor 135, the array 150, the mechanism 160 and the memory 140 will be described later.

The motors 35, 37 and 40, among the motors 31 to 40 and 58, and a toner motor 77 for supplying toner to the unit 12, are controlled by the group 71 through a motor driver 78. The motors 31 to 34 and 135 are controlled by a first sub-processor group 72 through a pulse motor driver 79. The motors 36, 38, 39 and 58 are controlled by a second sub-processor group 73 through a pulse motor driver 80. The lamp 4 is controlled by the group 71 through a lamp regulator 81, and the heater 23*a* is controlled by the group 71 through a heater control section 82. The group 71 supplies to the groups 72 and 73 control signals for designating driving/interruption of the motors. The groups 72 and 73 supply to the group 71, status signals representing the driving/interruption states of the motors. The group 71 receives position data from a position sensor 83. The position data represent the initial positions of the motors 31 to 34.

Figure 8:
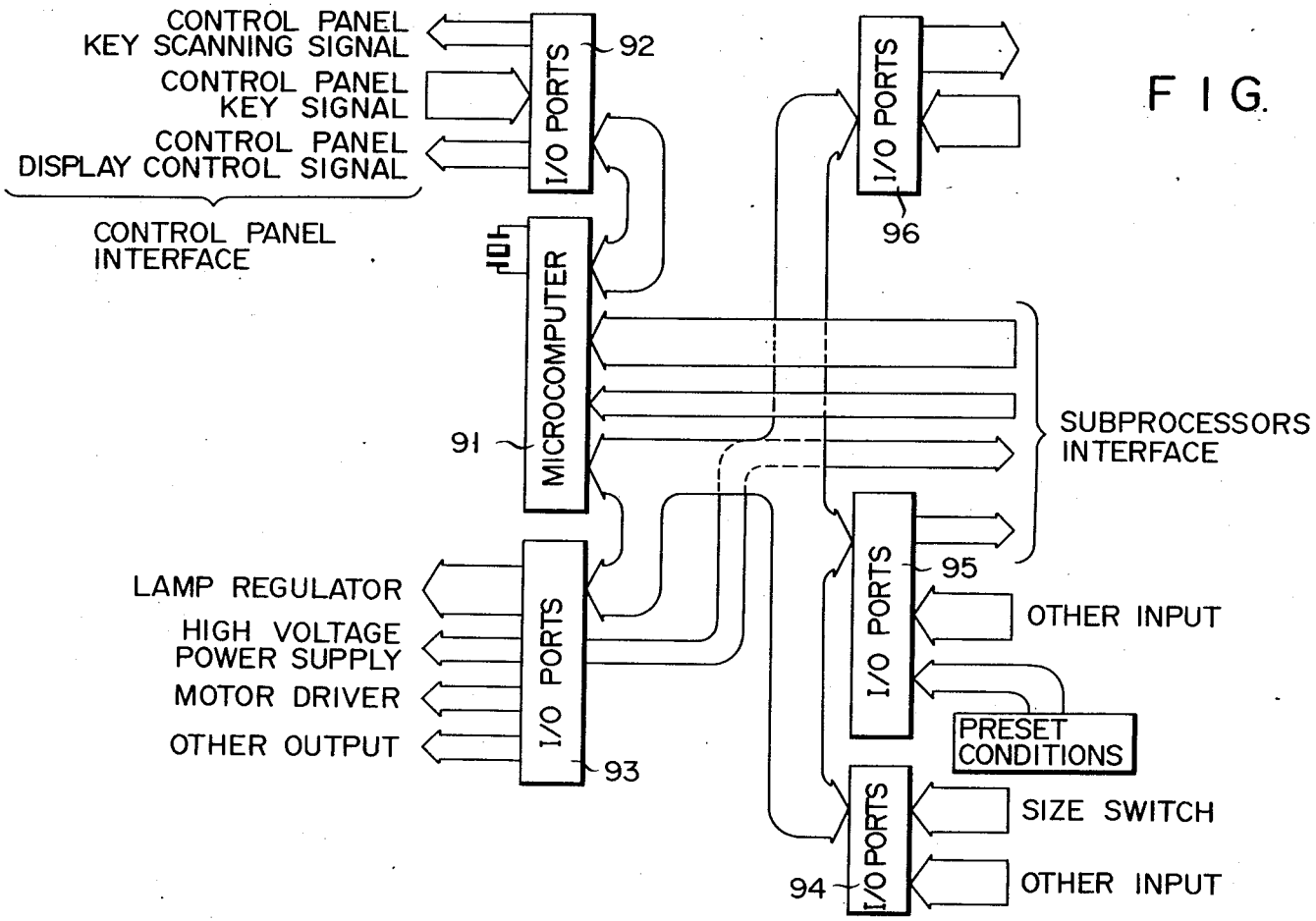

FIG. 8 shows an arrangement of the group 71. A one-chip microcomputer 91 detects key input at the control panel (not shown) and performs various display control operations through an I/O port 92. The microcomputer 91 can be expanded through I/O ports 93 to 96. The port 93 is connected to the transformer 76, the driver 78, the regulator 81 and other outputs. The port 94 is connected to the size switch for detecting paper size and other input. The port 95 is connected to the copying condition preset switch and other input. The port 96 serves as an optional port.

Figure 9:
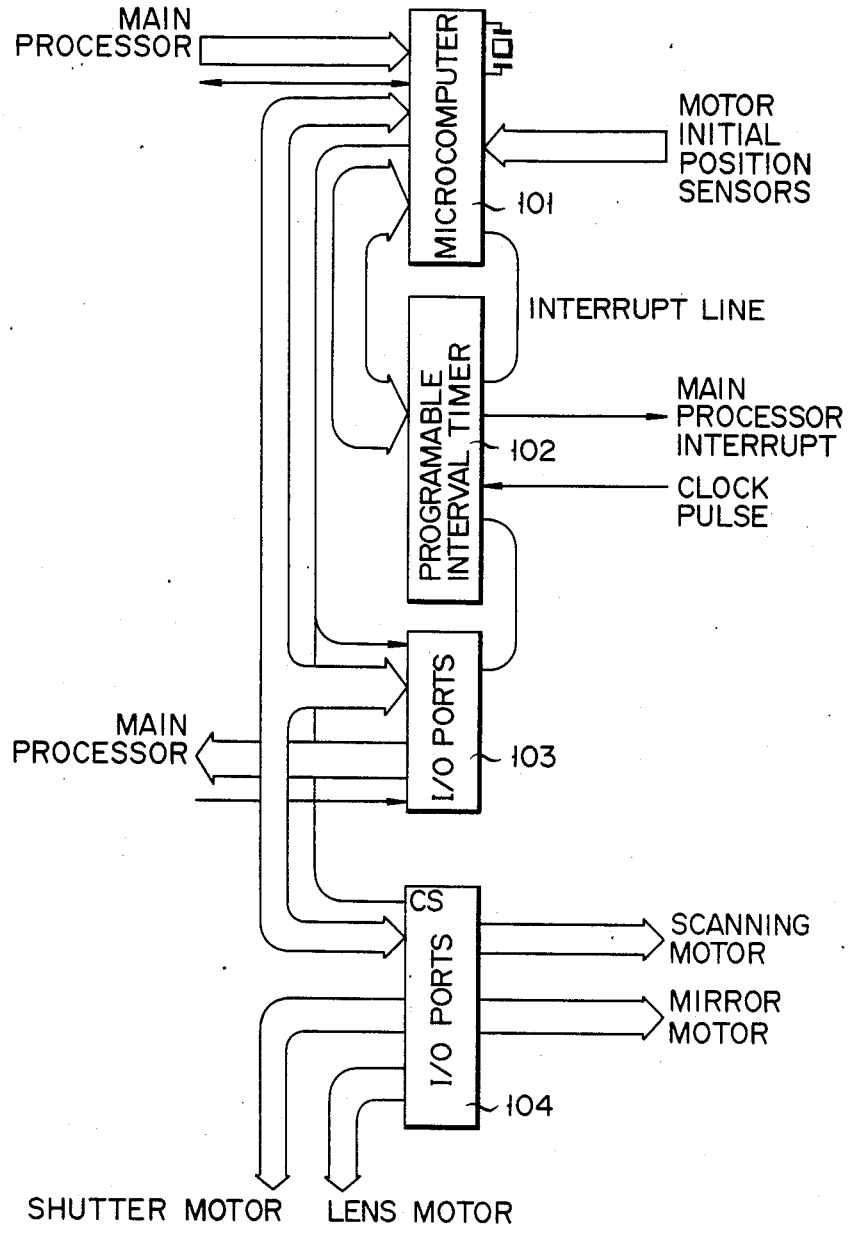

FIG. 9 shows an arrangement of the group 72. A microcomputer 101 is connected to the group 71. A programable interval timer 102 controls the switching interval of the pulse motor. A value is preset from the microcomputer 101 to the timer 102 and the timer starts counting the reference clock pulses. When the timer 102 count is completed, the timer 102 sends an end pulse onto an interrupt line of the microcomputer 101. The microcomputer 101 receives position data from the sensor 83 and is connected to I/O ports 103 and 104. The port 104 is connected to the motors 31 to 34 and 135 through the driver 79. The port 103 is used for supplying the status signals of the pulse motors to the group 71.

Figure 10:
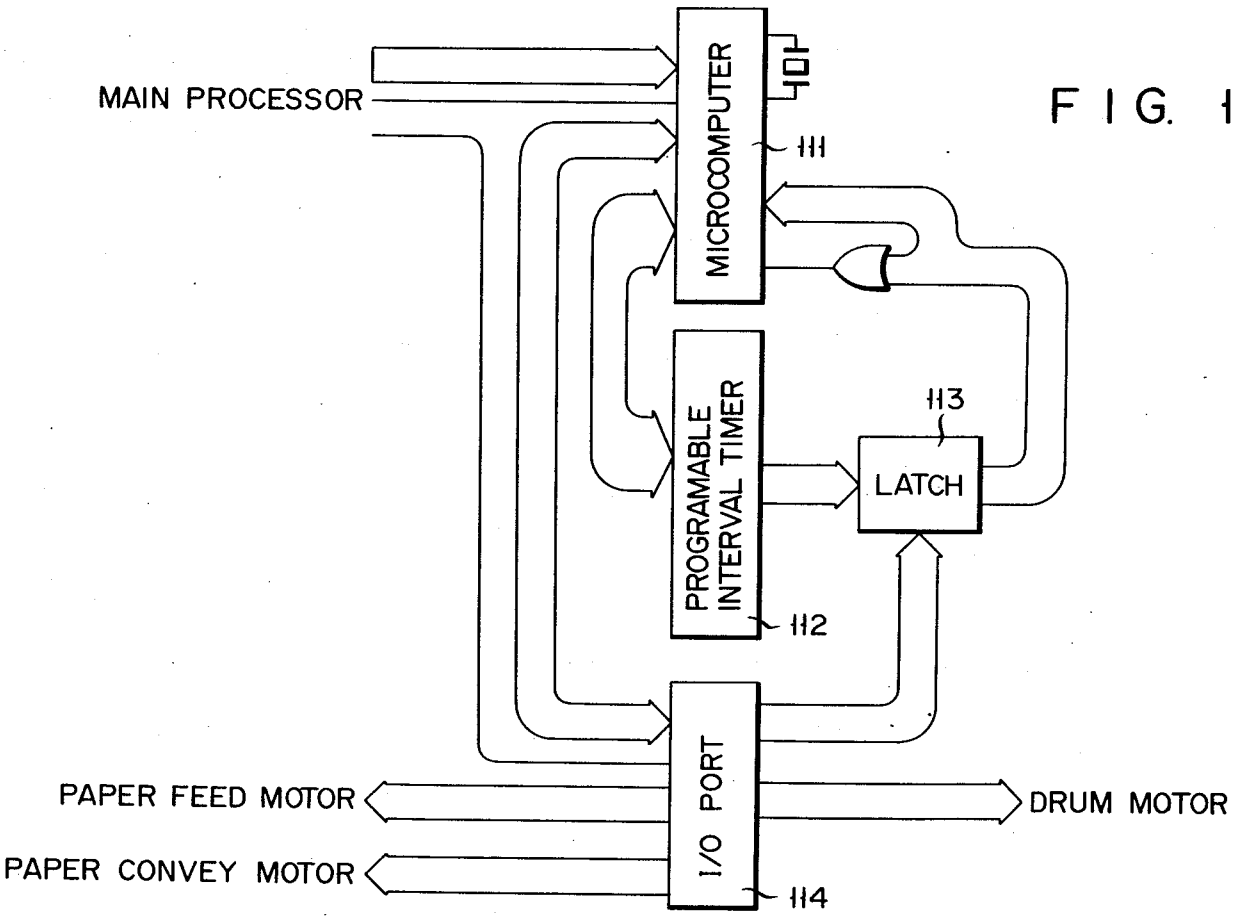

FIG. 10 shows an arrangement of the group 73. A microcomputer 111 is connected to the group 71. A programable interval timer 112 controls the switching interval of the pulse motor. When a value is preset from the microcomputer 111 to the timer 112, the timer 112 starts counting the reference clock pulses. When the timer 112 count is completed, an end pulse therefrom is latched by a latch 113. An output from the latch 113 is supplied to the interrupt line of the microcomputer 111 and the I/O port input line. The microcomputer 111 is also connected to an I/O port 114. The port 114 is connected to the motors 36, 38, 39 and 58 through the driver 80.

Figure 11:
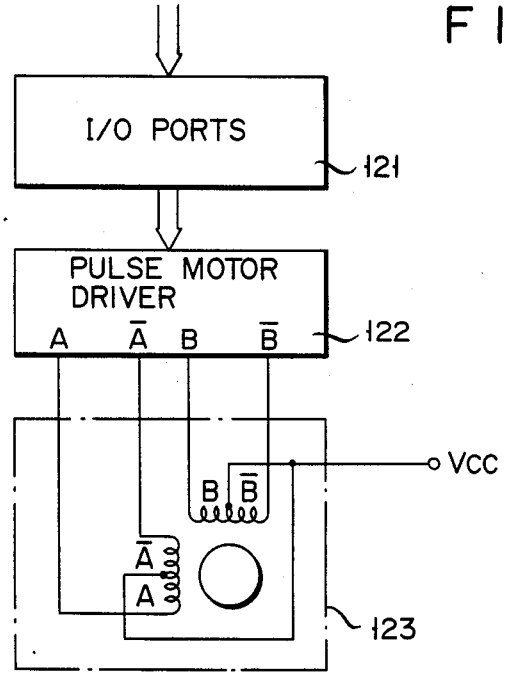

FIG. 11 shows a pulse motor control circuit. An I/O port 121 (corresponding to the ports 104 and 114 of FIGS. 9 and 10) is connected to a pulse motor driver 122 (corresponding to the drivers 79 and 80 of FIG. 7). The driver 122 is connected to windings A, B, $\overline{A}$ and $\overline{B}$ of a pulse motor 123 (corresponding to the pulse motors 31 to 34, 36, 38 and 39).

Figure 12:
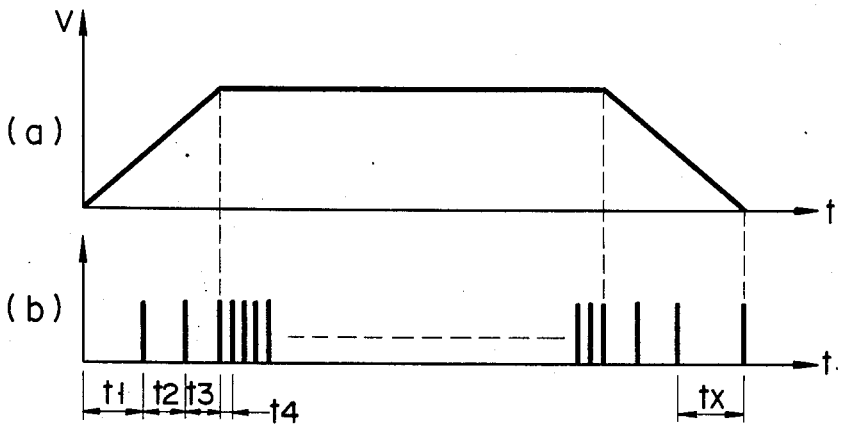

FIG. 12 shows a method of controlling the speed of the pulse motor. In FIG. 12, (a) shows the speed curve of the pulse motor, and (b) shows phase switching intervals. As is apparent from FIGS. 12(*a*) and 12(*b*), the switching intervals are long at the beginning, are gradually decreased, and are then finally equalized. Then, the intervals are prolonged, and the pulse motor is stopped. This cycle indicates the spin-up and spin-down of the pulse motor. The motor is started from the self-starting region, operated in a high-speed region and is gradually stopped. Reference symbols t1, t2, . . . tx denote times between the switching intervals.

Figure 13A:
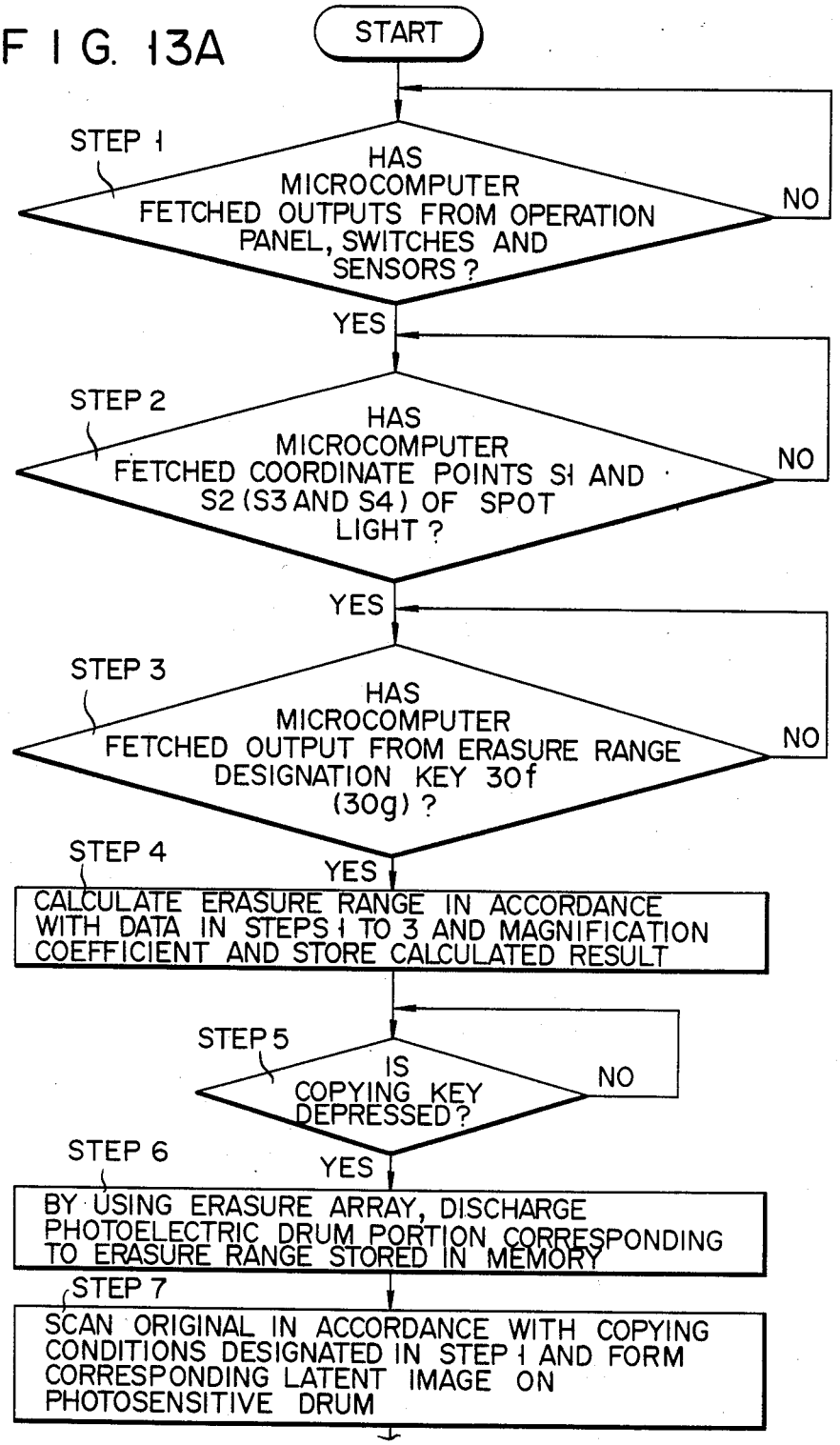
FIGS. 13A and 13B are flow charts explaining the operation of the main processor.
Figure 13B:
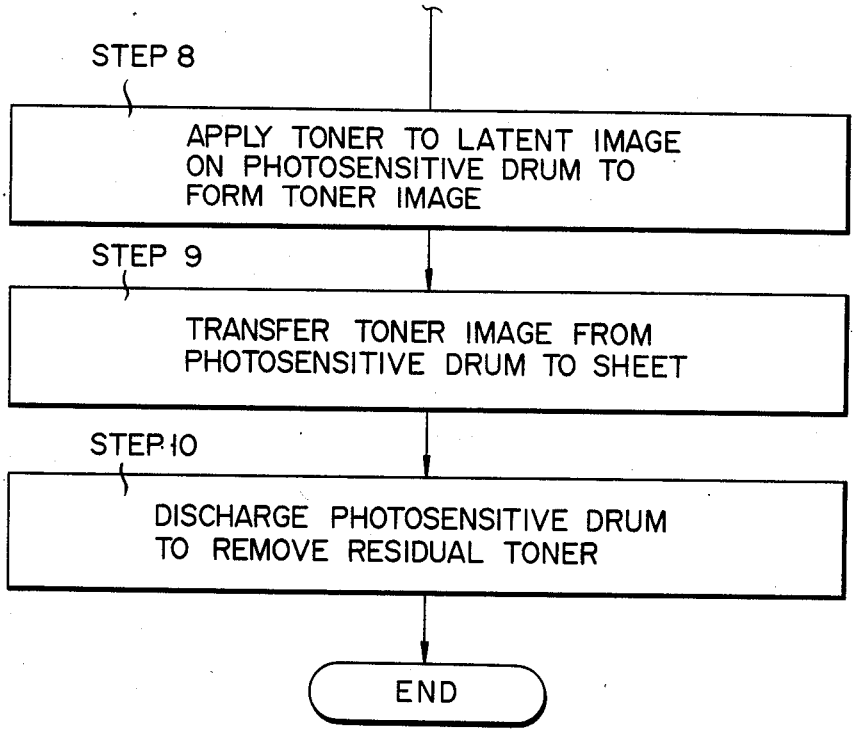

FIGS. 13A and 13B are flow charts explaining the operation of the one-chip microcomputer 91 in the group 71.

In step 1, the microcomputer 91 fetches output from the control panel, the switches and the sensors.

The microcomputer 91 checks in step 2 whether or not coordinate points S1 and S2 (S3 and S4) of the spot beam are read.

The microcomputer 91 checks in step 3 whether or not data from the key 30*f* (30*g*) is read.

In step 4, the data in steps 1 to 3 are stored into the memory. At the same time, an erasure range is calculated in accordance with the magnification coefficient, and the calculated value is stored in the memory.

The microcomputer 91 checks in step 5 whether or not the copying key is depressed.

In step 6, the portion of the charged photosensitive drum which corresponds to the erasure range is discharged by the erase array.

In step 7, the original is scanned and the corresponding latent image is formed on the photosensitive drum in accordance with the copying conditions designated in step 1.

In step 8, the toner is attached to the latent image on the photosensitive drum to form a toner image.

In step 9, the toner image is transferred from the photosensitive drum to the sheet.

In step 10, the photosensitive drum is discharged and the residual toner is removed.

Figure 14:
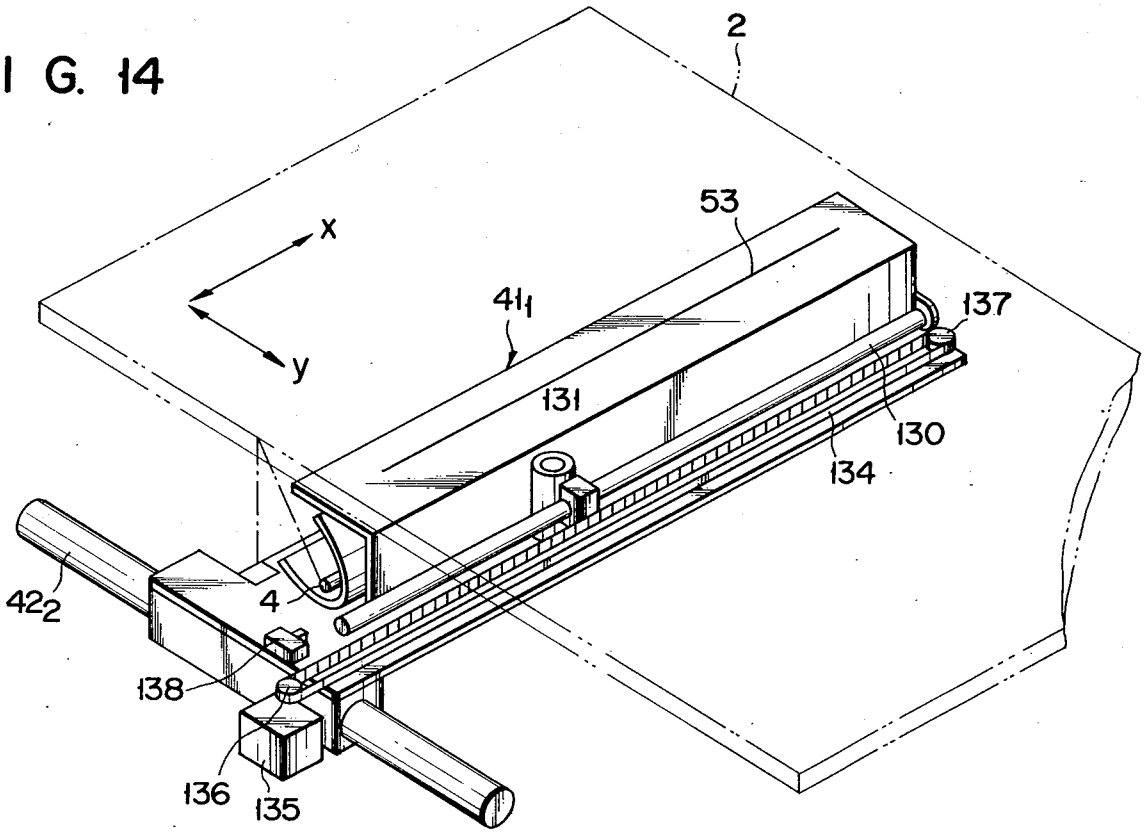
Figure 15:
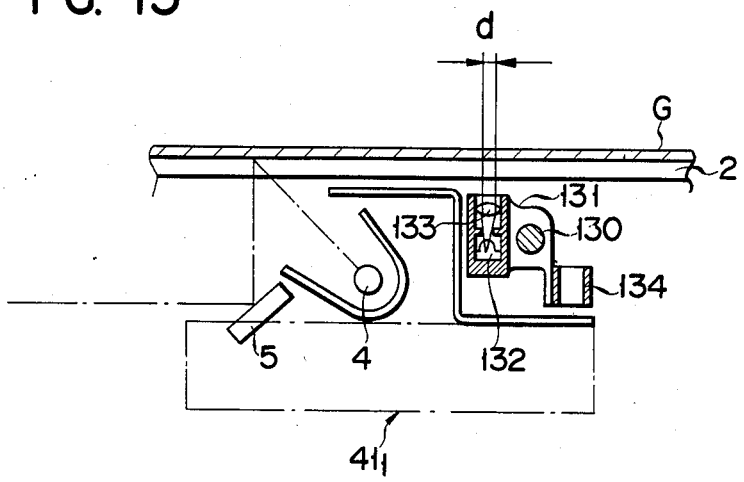

The arrangement of the section for erasing the unwanted portion of the original, and a method of designating the erasure range will be described as the main feature of the present invention, with reference to FIGS. 14 to 20. Referring to FIGS. 14 and 15, a guide shaft 130 is arranged in the carriage $41_1$ along the lamp 4 in a light-shielding portion for shielding light from the lamp 4. The source 131, as an erasure range designating means, is movably mounted on the shaft 130. As shown in FIG. 15, the source 131 is opposite the table 2 and comprises a light-emitting element 132 such as a light-emitting diode or a lamp, and a lens 133. Light from the element 132 is focused by the lens 133 to form a spotlight of a diameter d, which is then directed onto the table 2. The spotlight has sufficient luminance to transmit through an original G having the same thickness as that of a Bristol board. The source 131 is coupled to a timing belt (toothed belt) 134 disposed along the shaft 130. The belt 134 is looped between a drive pulley 136 mounted on the rotating shaft of the motor 135 and a driven pulley 137. When the motor 135 is rotated, the source 131 is moved along a direction perpendicular to the scanning direction of the carriage $41_1$. A position sensor 138 is arranged in the carriage $41_1$ and located near the pulse motor 135 at the end of the shaft 130. The sensor 138 comprises a microswitch for detecting an initial position of the source 131. When the source 131 is moved, it abuts against the sensor 138 which then detects the initial position of the source 131.

Figure 16:
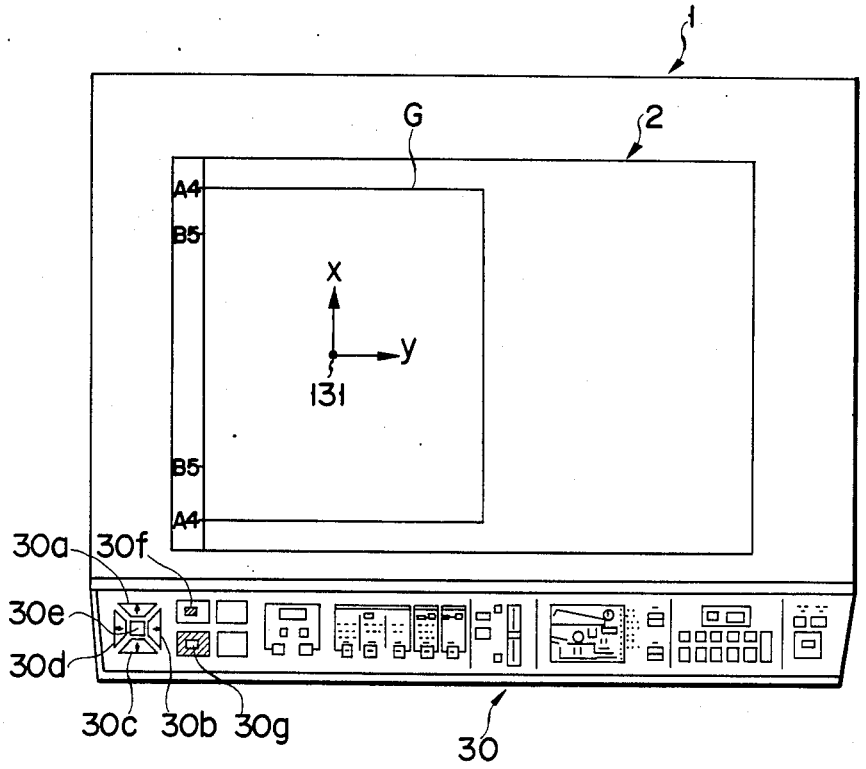
Figure 17:
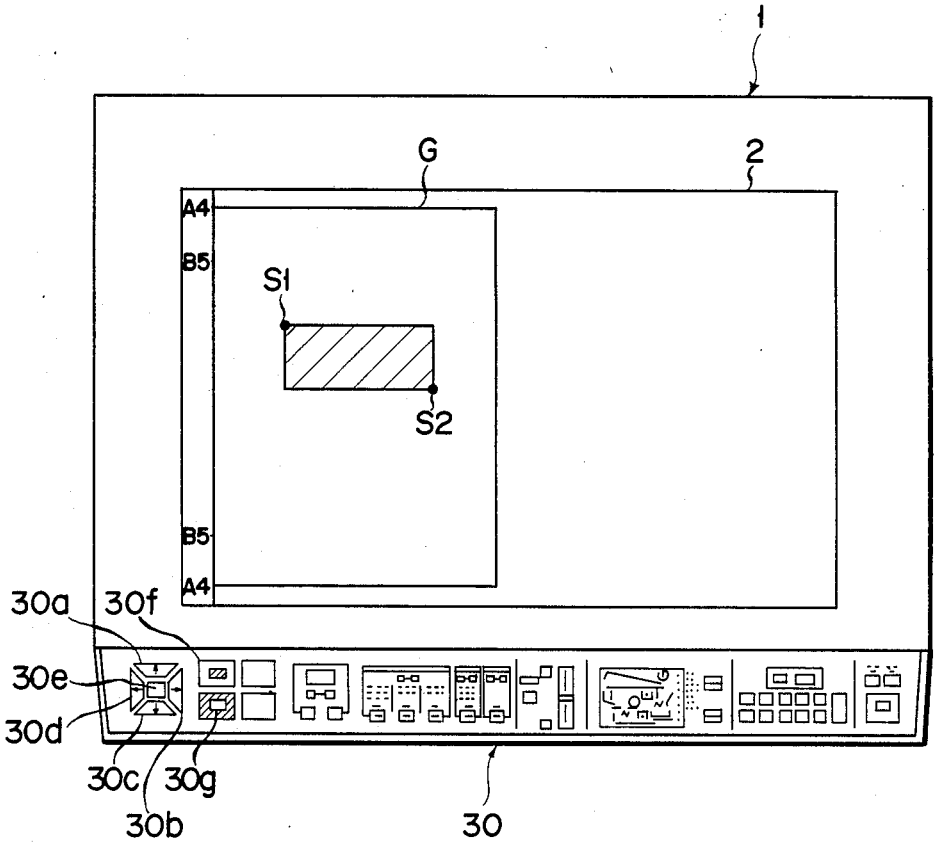
Figure 18:
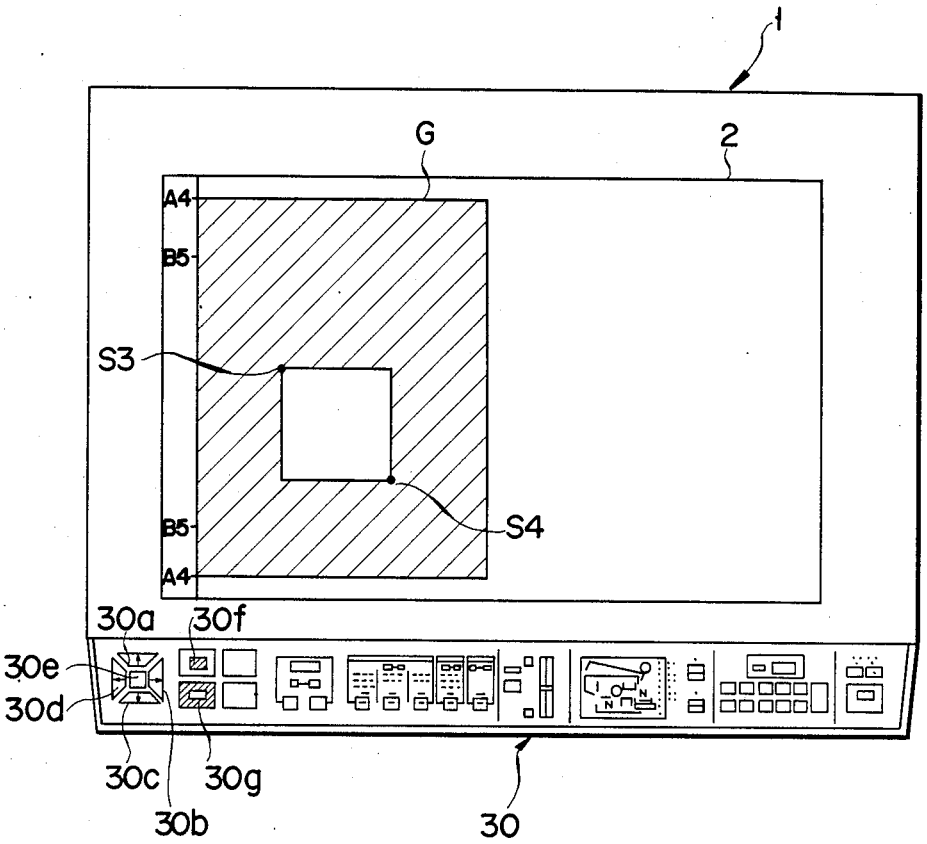
Figure 19:
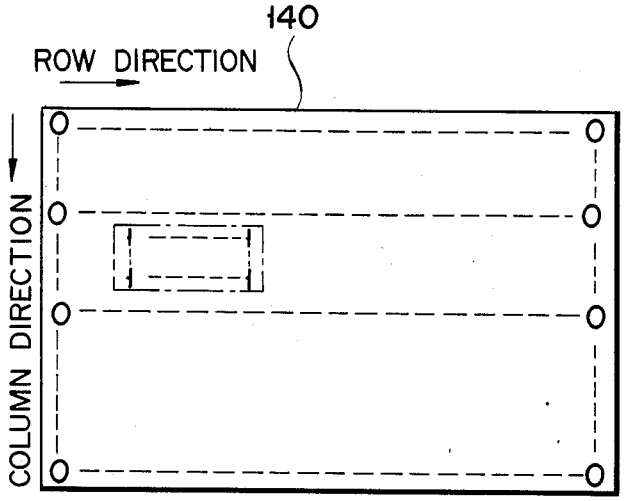
Figure 20:
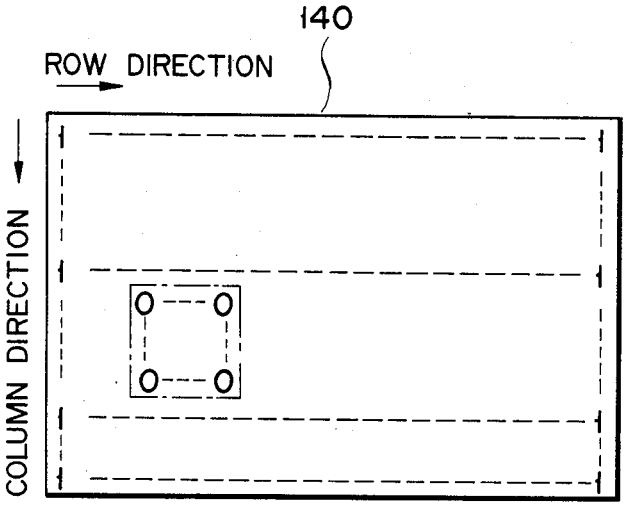

A method of designating the erasure range will be described with reference to FIGS. 16 to 20. The motors 33 and 135 are controlled upon operation of the keys 30*a* to 30*d* such that the source 131 is moved at a speed which is a multiple integer of the diameter of the spotlight. More specifically, when the keys 30*b* and 30*d* are depressed, the motor 33 is driven so that the carriage $41_1$ and the source 131 are moved along the scanning direction (i.e., the y direction in FIG. 15). When the operator depresses the keys 30*a* and 30*c*, the motor 135 is driven and the motor 135 is moved along a direction (i.e., the x direction in FIG. 15) perpendicular to the scanning direction of the source 131. The operator selectively depresses the keys 30*a* to 30*d* while he visually checks the spotlight transmitted through the original G. For example, the operator depresses the key 30*e* while the spotlight refocused to the point S1 on the original G. The designated point S1 is stored in the group 71 shown in FIG. 7. Similarly, when the operator moves the spotlight to the point S2 of the original G and depresses the key 30*e*, the point S2 is stored in the group 71. The positions of the spotlight can be detected by counting the drive pulses of the motors 33 and 135. Thereafter, when the operator depresses the key 30*f*, a rectangular area, (indicated by the hashed area) having diagonal points S1 and S2, is designated as the erasure range, as shown in FIG. 16. When the points S3 and S4 of the original G are designated and the key 30*g* is depressed, as shown in FIG. 18, a portion, except for a square having diagonal points S3 and S4, is designated as the erasure range. When the keys 30*f* and 30*g* are depressed, the group 71 performs a calculation in accordance with the designated two points and the copying magnification coefficient. Data of logic "1" is set in a memory area corresponding to the erasure range in the memory 140, and data of logic "0" is set in the remaining memory area. The column capacity of the memory 140 substantially corresponds to the value given by the distance the source 131 has moved along the x direction divided by the position resolution thereof along the x direction. A row capacity of the memory 140 substantially corresponds to the value given by the distance the source 131 has moved along the y direction divided by the position resolution thereof along the y direction. The memory 140 comprises a RAM having the memory capacity described above. In the case of FIG. 17, high level signals are stored at addresses corresponding to the hashed area and low level signals are stored at other addresses in response to the data supplied from the group 71, as shown in FIG. 19. Equally, in the case of FIG. 18, high level signals are stored at addresses corresponding to the hashed area and low level signals are stored at other addresses, as shown in FIG. 20.

Figure 21:
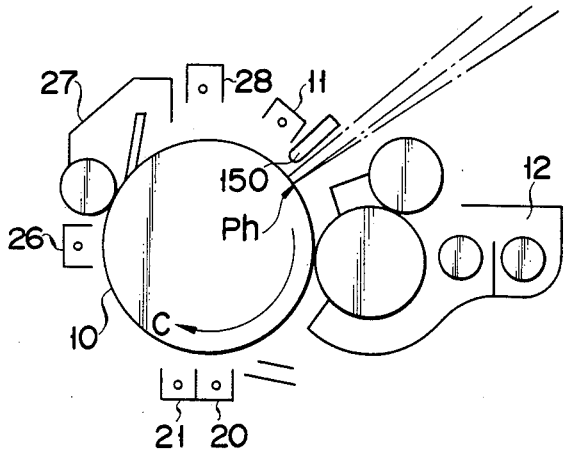
Figure 22:
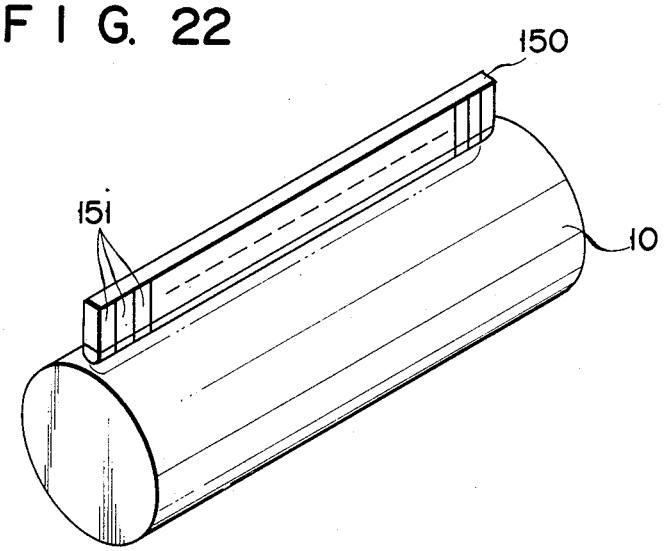
Figure 23:
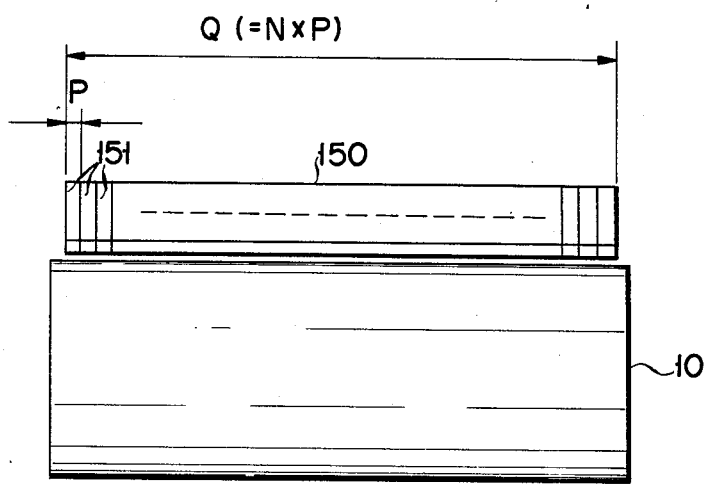
Figure 24:
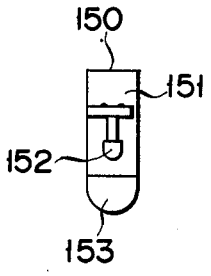
Figure 25:
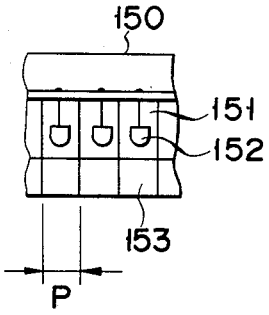

As shown in FIG. 21, the erasure array 150, as an erasing means, is arranged near the drum 10 between the charger 11 and an exposure portion Ph. The array 150 has a plurality of light-shielding cells 151 aligned along a direction perpendicular to the rotational direction of the drum 10, as shown in FIGS. 22 and 23. As shown in FIGS. 24 and 25, light-emitting elements 152, comprising light-emitting diodes, are arranged in the cells 151. A lens 153 is arranged in the opening of each cell 151 lying opposite to the drum 10, to focus light onto the surface of the drum 10. The number of light-emitting elements arranged in the erasure array 150 corresponds to the column capacity of the memory 140. When the distance (i.e., an erasure pitch) between the two adjacent elements 152 is given as P, an overall length of the array 150 is given as $Q=N\times P$.

Figure 26:
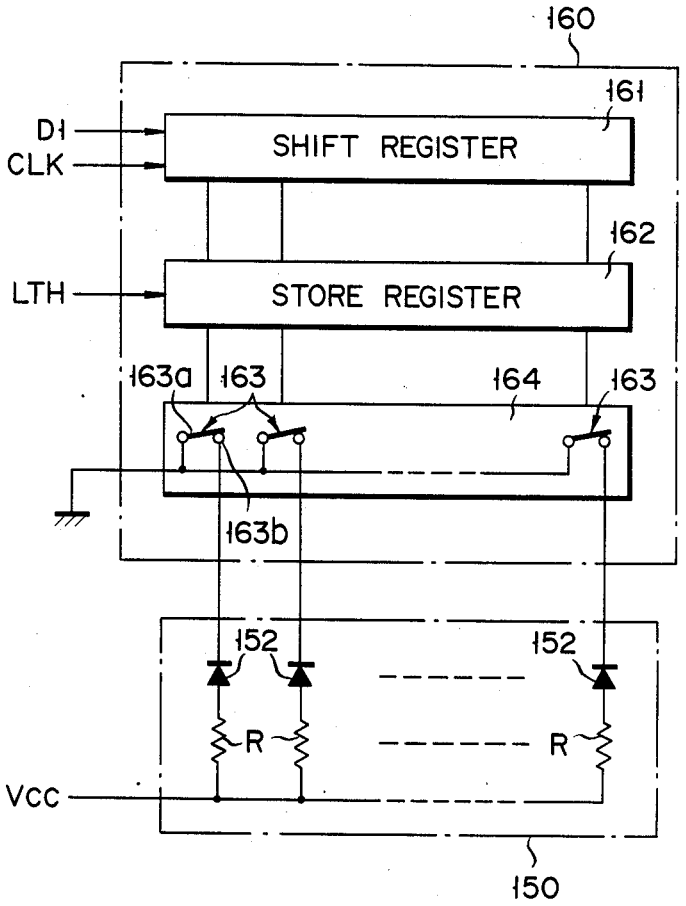

The array 150 is driven by the mechanism 160. As shown in FIG. 26, the mechanism 160 comprises a shift register 161 having the same bit number as the column bit number of the memory 140, a store register 162 for storing the contents of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After the operator designates the erasure range of the original, he closes the original cover $1_1$ and depresses the key $30_1$. The carriage $41_1$ and the drum 10 are operated, and, at the same time, one-column data is read out from the memory 140 in the row direction, as indicated in FIG. 19. The readout data D1 is transferred to the register 161 in the mechanism 160 in response to a clock signal CLK. When one-column data is transferred to the register 161, the charged portion of the drum 10 reaches the array 150 and the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-row data is transferred from the memory 140 to the register 162 prior to $\theta 1/\omega$, where $\theta 1$ is the angle between the array 150 and the portion Ph and $\omega$ is the peripheral velocity of the drum 10.

The elements 163 in the circuit 164 are controlled in response to the output signal from the register 162. When the output level of the register 162 is set at a high level, the elements 163 are turned on. Otherwise, the elements 163 are turned off. The elements 152, connected to the elements 163, are turned on when the elements 163 are turned on. Otherwise, the elements 152 are turned off. A charged drum portion corresponding to the ON elements 152 is discharged, and the remaining portion is not discharged, so that a latent image is formed in the remaining portion even if the surface of the drum 10 is exposed with light. In this manner, the unwanted portion of one column can be erased. The data is thus read out from the memory 140 in units of columns, thereby erasing the unwanted image portion as the drum is rotated.

Figure 27:
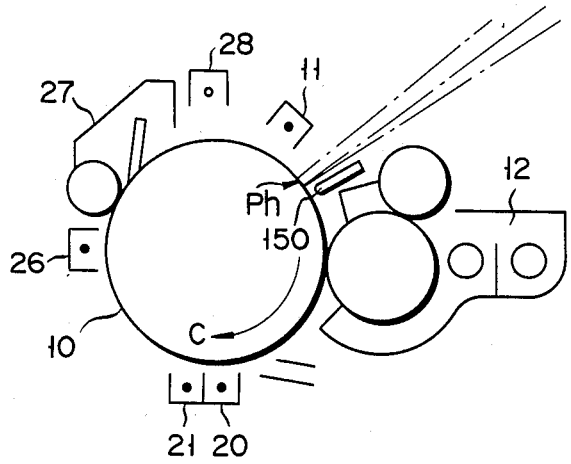

The position of the array 150 is not limited to a location between the charger 11 and the portion Ph, but can be located between the portion Ph and the unit 12 so as to erase the latent image in accordance with the designated data, as shown in FIG. 27.

The capacity of the memory may be changed as needed.

A relationship between the diameter d of the spotlight emitted by the source 131 onto the table 2, and the distance (the erasure pitch) between the two adjacent elements 152 in the array 150 is given as follows:

$$d=P$$

Figure 28:
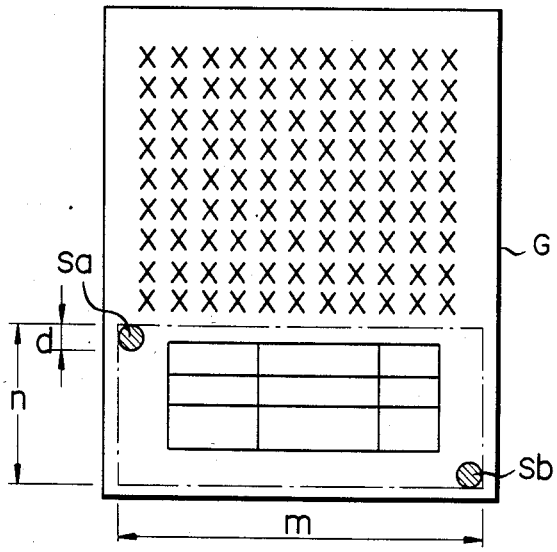

The diameter d of the spotlight is an ideal one since diffusion caused by scattering of light transmitted through the original must be considered. As described above, the spotlight is moved at a speed which is an integer multiple of the diameter d. When the portion surrounded by the broken line of FIG. 17 is given as the erasure range, a range (x,y) designated by Sa and Sb, as shown in FIG. 28, is given by:

$$x=d\times n$$

$$y=d\times m$$

where n and m are integers, respectively.

Figure 29:
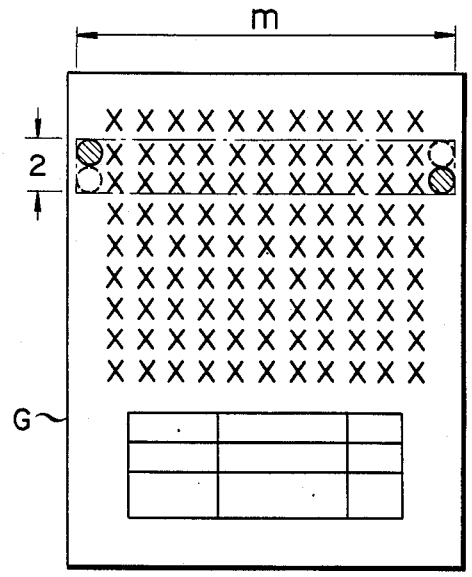

When the erasure range is given as indicated by the broken line of FIG. 18, the range (x,y) is given as shown in FIG. 29 by:

$$x=d\times 2$$

$$y=d\times m$$

When the diameter d of the spotlight is equalized with the erasure pitch P, the designated erasure range coincides with the actual erasure range. Therefore, the operator can easily recognize the erasure range.

Figure 30:
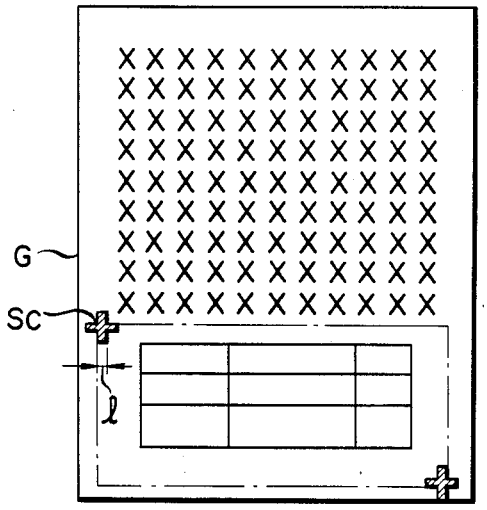
FIG. 30 is a view of another shape of the spotlight.

FIG. 30 shows a case wherein spotlight Sc has a cross shape and an erasure range is determined by two adjacent sides each having the width l.

What is claimed is:

1. An image forming apparatus, wherein an original is scanned, a photosensitive body which is uniformly precharged is exposed with light to form a charge pattern corresponding to an image of the original, and the charge pattern is developed to form a developed image, the apparatus comprising:

an original table on which an original is placed;

scanning means for scanning an original placed on said original table in a prescribed scanning direction;

indicator means including a spotlight source for indicating a specific position or range on a surface of the original placed on said original table by moving a spotlight from said spotlight source along a surface of the original table;

supporting means which is movable along said original table in the scanning direction for supporting said scanning means in a fixed manner in a direction normal to the scanning direction and for movably supporting said indicator means in the direction normal to the scanning direction;

driving means for driving said supporting means and said indicator means; and erase means for erasing charges on the photosensitive body corresponding to the specific position or the range of said original indicated by said indicator means.

2. An apparatus according to claim 1, wherein said erase means comprises a plurality of light-emitting elements which are aligned at a pitch substantially corresponding to a diameter of the spotlight source along a longitudinal direction of said photosensitive body, and which discharge the portion of said photosensitive drum which is designated by said indicator means.

3. An apparatus according to claim 1, wherein said indicator means comprises light-emitting elements and a lens which focus the spotlight onto the surface of the original and which are arranged in said scanning means, said indicator means being moved by said scanning means at a speed which is an integer multiple of the diameter of the spot light.

4. An apparatus according to claim 1, wherein said erase means comprises a plurality of light-emitting elements.

5. An apparatus according to claim 4, wherein said plurality of light-emitting elements of said erase means are arranged between said charging means of said photosensitive body and said image exposure means.

6. An apparatus according to claim 4, wherein said plurality of light-emitting elements in said erase means are arranged between said image exposure means of said photosensitive body and said developing means.

7. An apparatus according to claim 1, wherein said indicator means is arranged in said scanning means.

8. An apparatus according to claim 7, wherein said indicator means comprises light-emitting elements and a lens which focus the spotlight onto the surface of the original.

9. An apparatus according to claim 7, wherein said erase means comprises a plurality of light-emitting elements aligned in a direction parallel to the longitudinal direction of said photosensitive body.

10. An apparatus according to claim 9, wherein said plurality of light-emitting elements of said erase means are arranged between said charging means of said photosensitive body and said image exposure means.

11. An apparatus according to claim 9, wherein said plurality of light-emitting elements in said erase means are arranged between said image exposure means of said photosensitive body and said developing means.

12. An apparatus according to claim 7, wherein said scanning means is driven by a pulse motor.

13. An apparatus according to claim 1, wherein said driving means includes a first driving means for driving said supporting means in the scanning direction; and a second driving means for driving said indicator means supported on said supporting means in the direction normal to the scanning direction.

14. An apparatus according to claim 13, wherein said second driving means is mounted on said supporting means.

15. An apparatus according to claim 1, wherein said supporting means includes a guide means for guiding said indicator means in the direction normal to the scanning direction.

* * * * *